United States Patent [19]

Parkins

[11] 4,380,972

[45] Apr. 26, 1983

[54] INTERNAL COMBUSTION ENGINES

[76] Inventor: Malcolm F. Parkins, Elm Tree Cottage, South End, Ogbourne St. George, near Marlborough, Wiltshire, England

[21] Appl. No.: 166,824

[22] Filed: Jul. 8, 1980

[30] Foreign Application Priority Data

Jul. 9, 1979 [GB] United Kingdom ..... 7934966
Jul. 10, 1979 [GB] United Kingdom ..... 7924037

[51] Int. Cl.[3] ..... F02B 75/04

[52] U.S. Cl. ..... 123/78 F; 123/52 A; 123/315; 123/197 AC

[58] Field of Search ..... 123/48 R, 48 B, 78 R, 123/78 E, 78 F, 52 A, 315, 197 R, 197 AC

[56] References Cited

U.S. PATENT DOCUMENTS

| | | | |
|---|---|---|---|
| 367,496 | 8/1887 | Atkinson | 123/78 F |
| 441,582 | 11/1890 | Quaek | 123/78 F |
| 1,261,058 | 4/1918 | Samain | 123/315 |
| 1,874,195 | 8/1932 | King | 123/78 F |
| 2,199,625 | 5/1940 | Fiala-Fernbrugg | 123/78 F |
| 3,021,825 | 2/1962 | Garcia de la Para | 123/51 |
| 4,092,957 | 6/1978 | Tryhorn | 123/78 F |

FOREIGN PATENT DOCUMENTS

| | | | |
|---|---|---|---|
| 428838 | 9/1911 | France | 123/78 F |
| 1316536 | 12/1962 | France . | |
| 3976 | of 1900 | United Kingdom | 123/78 F |
| 240832 | 3/1926 | United Kingdom . | |
| 274432 | 5/1928 | United Kingdom . | |
| 339955 | 12/1930 | United Kingdom . | |

*Primary Examiner*—Craig R. Feinberg
*Attorney, Agent, or Firm*—Larson and Taylor

[57] ABSTRACT

To improve the performance of four-stroke internal combustion engines, the piston P of each cylinder C is connected by a connection rod to an intermediate point of a floating link, which point is constrained, for instance by a tracking arm, to travel substantially rectilinearly, and the ends of the floating link are joined by connection rods to primary and secondary crank shafts which are coupled together to rotate at a selected ratio of different rotational speeds, the ratio best being 2:1. The arrangement is such as to give a longer power stroke than induction stroke. Further the cylinder may be provided both with a normal valve-controlled exhaust port and with exhaust ports which are only uncovered at the end of the power stroke.

2 Claims, 10 Drawing Figures

INTERNAL COMBUSTION ENGINES

DESCRIPTION

The invention relates to four-stroke internal combustion engines.

In conventional engines of this kind, the swept volumes of the induction and power strokes are substantially identical and, as is known, considerable energy is lost in the discharged exhaust gases.

Also due to connection of the piston, or each piston, to a crank shaft by means of a connecting rod, high side loads and high friction losses are experienced.

The invention seeks to reduce these losses.

According to the invention, in a four-stroke internal combustion engine the, or each, piston is drivingly connected by a linkage to two crank shafts which rotate at a selected ratio of different rotational speeds such that the piston partakes of a longer power stroke than induction stroke, the linkage including a piston connection rod which is constrained in operation to travel substantially rectilinearly.

The piston connection rod may be constrained to substantially rectilinear travel by a tracking arm of substantial length which has one end pivoted on the engine fixed structure, e.g. its casing, and the other end pivoted to a point of the piston connection rod remote from the piston so that this point travels in a shallow arc.

The linkage in a convenient form may comprise separate connection rods for the crank shafts joined to respective ends of a floating link to which the piston connection rod is pivoted at an intermediate point. In such a form, the intermediate point can be nearer the end of the link to which the connection rod of the faster rotating crankshaft is connected.

In the basic construction of the improved engines of this invention, not only is there greater utilisation of the combustion energy, but also side loads on the cylinder wall due to swinging of the piston connection rod as occurs in conventional engines are eliminated to a large extent.

The present invention seeks to improve even further the operational efficiency of such engines as compared with conventional engines and according to a feature of the invention each cylinder is provided, in addition to a conventional upper cylinder valve controlled exhaust port, with lower exhaust ports which are uncovered by the piston only towards the end of the power stroke, but not in the induction stroke, thus allowing substantial reduction of the quantity of exhaust gas to be discharged through the upper end exhaust valves during the exhaust stroke thereby effecting a saving in energy.

Some engine arrangements constructed in accordance with this invention will now be described with reference to the accompanying drawings, in which.

Figure 1:
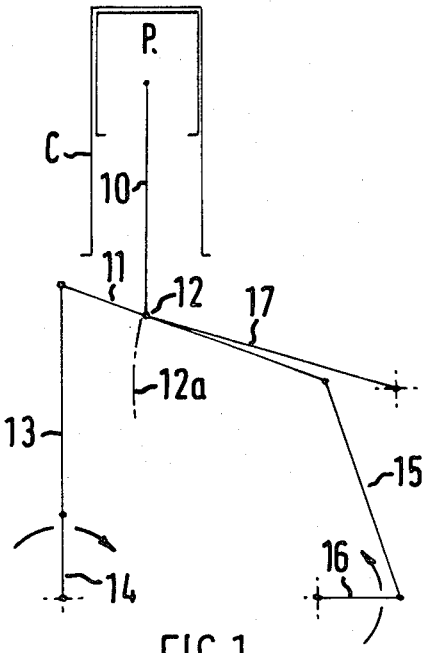
FIGS. 1 to 4 show the operating cycle of a single cylinder engine.
Figure 2:
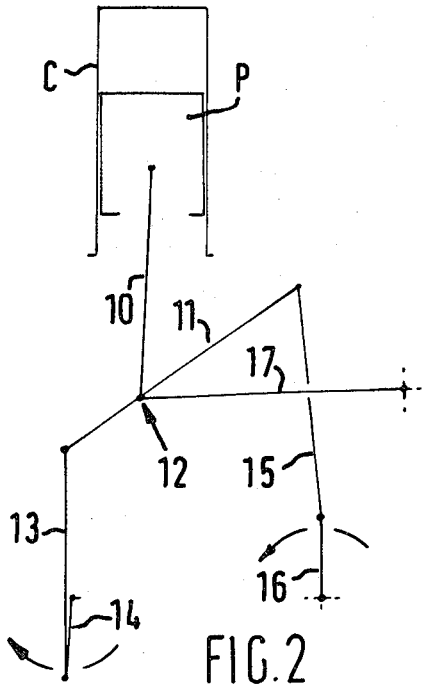
Figure 3:
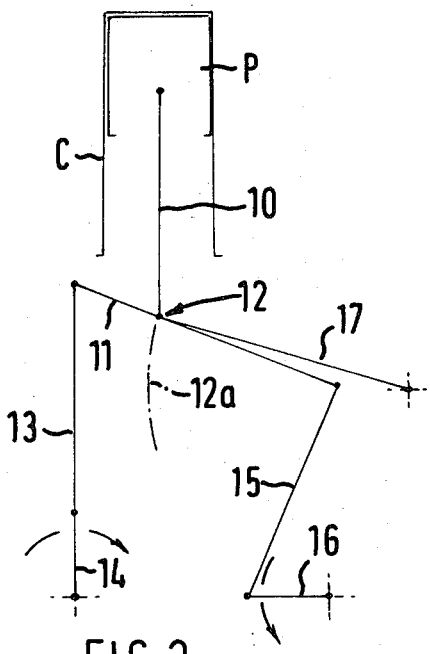

Referring to FIGS. 1 to 4, the engine utilises two crank shafts, namely a 'primary crank shaft' 14, and a 'secondary crank shaft' 16, which shafts are rotationally locked to each other via gear wheels, pulley wheels and chains, or similar devices, such that the secondary crank shaft 16 rotates at half the speed of the primary crank shaft 14. The shafts rotate in opposite directions in the example described.

'Primary' and 'secondary' connection rods 13, 15 are connected by one end to the primary and secondary crank shafts 14, 16 respectively and have their other ends on respective ends of a floating link 11.

A 'piston' connection rod 10 is pivoted by one end to the piston P and at the other to the link 11 at a point ⅓ of the link length from the end to which the primary connection rod 13 is pivoted.

A 'tracking arm' 17 is used in this version of the engine, the arm being pivotally secured at one end on the engine fixed structure, e.g. its casing, and at the other end to the link 11 at the same position as the piston connection rod 10.

The tracking arm 17 acts to stabilise the three connection rods and the floating link, and restrict movement of the overall mechanism to mechanically defined positions on a shallow arc 12*a* (FIG. 1) through which the end connected to the link travels.

Further the tracking arm holds the link and small ends of the primary and secondary connection rods 13, 15 in the plane of the particular cylinder C, and big end journals of the primary and secondary crank shafts concerned, to prevent fore and aft instability.

Alternatively, a slider and guide mechanism may be used to fulfill the same function, particularly that of preventing substantial deviation of the piston connection rod 10 from rectilinear travel.

OPERATION

For the purpose of describing the operating principle, it is assumed that:

(a) the primary crank shaft 14 rotates clockwise, and the secondary crank shaft 16 anticlockwise.

(b) at the start of the induction stroke, (FIG. 1), the piston P will be contained within the cylinder C at its closest position to the cylinder head; that the big end of the primary connection rod 13 will be nominally at top dead centre, and the big end of the secondary connection rod 15 nominally at 90° prior to top dead centre.

In practice relative dimensions of the three connection rods 10, 13, 15, the link 11 and tracking arm 17, and the crank shaft throws, will not permit these angles to occur precisely as stated.

INDUCTION STROKE

As the induction stroke proceeds, the big end of the primary connection rod 13 moves progressively through 180° clockwise to bottom dead centre, and at the same time the big end of the secondary connection rod moves progressively through 90° anticlockwise to top dead centre.

At the end of the induction stroke (FIG. 2), the primary connection rod 13 will have lowered its end of the link 11 nominally to its lowest postion, and at the same time the secondary connection rod 15 will have raised its end of the link 11 nominally to its highest position. The link 11 will have lowered itself slightly and rotated anticlockwise, and consequently the piston connection rod 10, which is attached to the link at a position closer to the primary connection rod attachment than the secondary connection rod attachment, will draw the piston P down the cylinder C through the required induction stroke swept volume.

COMPRESSION STROKE

As the compression stroke proceeds, the big end of the primary connection rod 13 moves progressively through 180° clockwise to top dead centre, and at the same time the big end of the secondary connection rod 15 moves progressively through 90° anticlockwise to 90° after top dead centre. The link 11 will have been raised and rotated clockwise to the position of FIG. 3, and the piston P and piston connection rod 10 will have returned nominally to the position it had at the start of the induction stroke.

POWER STROKE

Figure 4:
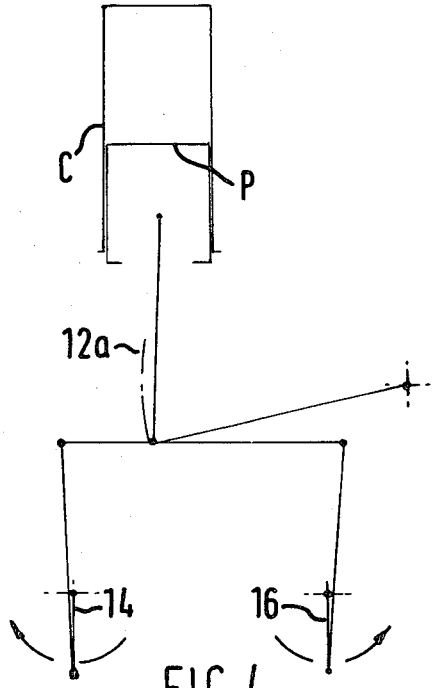

As the power stroke proceeds, the big end of the primary connection rod 13 moves progressively through 180° clockwise, and at the same time the big end of the secondary connection rod 15 moves progressively through 90° anticlockwise, both then being at bottom dead centre (FIG. 4). The link 11 will have been lowered to its lowest position, and the piston P allowed to 'work' through the extended power stroke swept volume.

EXHAUST STROKE

As the exhaust stroke proceeds, the big end of the primary connection rod moves progressively through 180° clockwise to top dead centre, the big end of the secondary connection rod anticlockwise to 90° before top dead centre, and the piston P to its closest position to the cylinder head. At the end of this stroke the cycle will have been completed and the parts will be as in FIG. 1.

POWER OUTPUT

Power output will normally be taken from the primary crank shaft.

FUEL OPTIONS

Any fuel usable in conventional piston driven internal combustion engines may be used (e.g. petroleum, diesel oil, gases of various types, heavy and light fuel oils etc.).

A variety of engine configurations are possible, and the following are examples.

Figure 5:
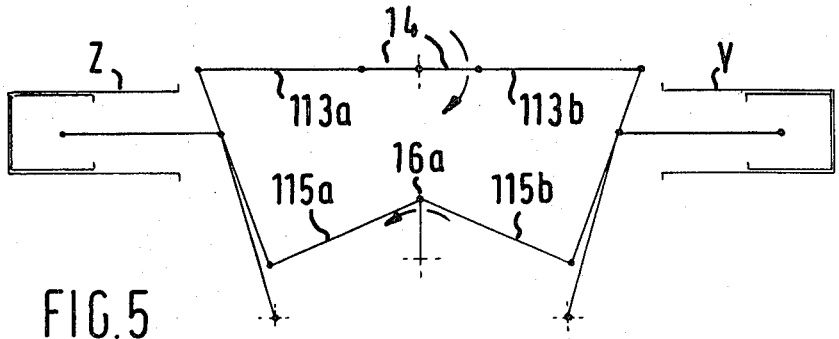
FIGS. 5 and 6 illustrate one multiple cylinder arrangement.
Figure 6:
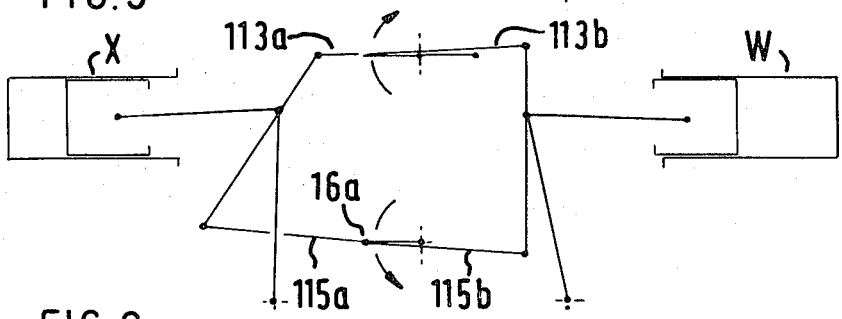

In FIGS. 5 and 6, a twin bank horizontal configuration is illustrated in which the big ends of the primary connection rods 113*a*, 113*b* are mounted rotationally 180° apart on the primary crank shaft 14, and the big ends of the secondary connection rods 115*a* and 115*b* are rotationally on a common journal axis 16*a* on the secondary crank shaft 16.

Figure 7:
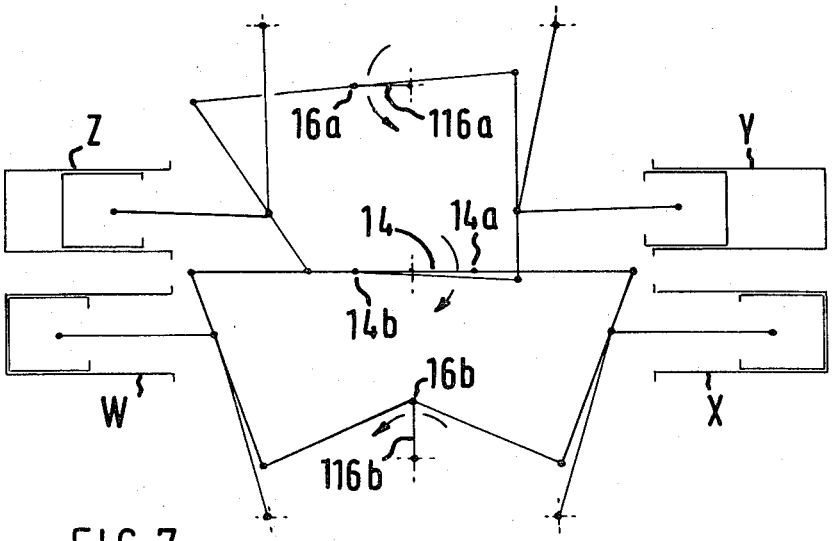
FIG. 7 illustrates a second multiple cylinder arrangement.

The cylinders are illustrated respectively at the start of the following strokes:

Cylinder Z: induction
Cylinder Y: power
Cylinder X: compression
Cylinder W: exhaust FIG. 7 illustrates a quadruple bank configuration in which the primary connection rods of cylinders Z, X are mounted rotationally on a common journal axis 14*a* on the primary crank shaft 14, and the primary connection rods of cylinders Y and W on a common journal axis 14*b* 180° apart from axis 14*a*.

The secondary connection rods of cylinders Z, Y are rotationally on a common journal axis 16*a* on secondary crank shaft 116*a* and the secondary connection rods of cylinders X and W, on a common journal axis 16*b* on secondary crank shaft 116*b*.

Figure 8:
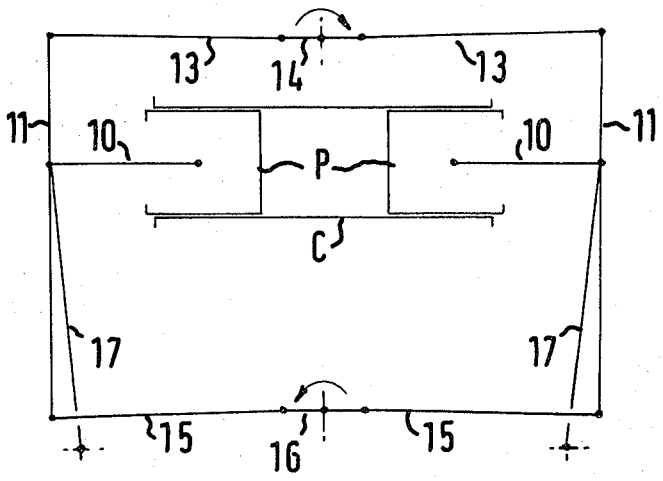
FIG. 8 illustrates a third multiple cyinder arrangement.

The cylinders are illustrated respectively at the start of the following strokes:

Cylinder Z: compression
Cylinder Y: exhaust
Cylinder X: power
Cylinder W: induction FIG. 8 illustrates a configuration in which two pistons oppose each other in each cylinder; this configuration offers advantages from an engine balancing point of view. The illustration shows this variant at the start of the exhaust stroke. The references are the same as for FIGS. 1 to 4.

Figure 9:
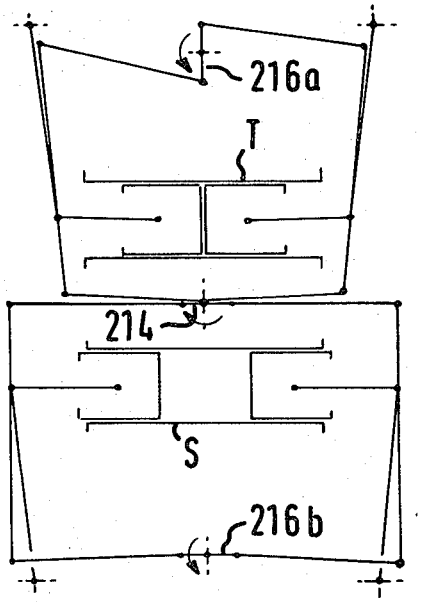
FIG. 9 illustrates a fourth multiple cylinder arrangement.

FIG. 9 illustrates a twin cylinder bank variant of FIG. 8, incorporating one primary crankshaft 214 and two secondary crank shafts 216*a*, 216*b*.

The illustration shows cylinders T and S commencing induction and exhaust strokes respectively.

A variety of radial, and squat or low profile engine configurations are also achievable.

The common features of all engines operating on the principle of this invention are:

(I) that the piston or each piston sweeps through a greater volume on the power stroke than is swept during the induction stroke, and hence extracts a quantity of that energy which would normally be lost by a conventional piston engine, and (II) that piston side loadings are minimised so that frictional losses are reduced.

Figure 10:
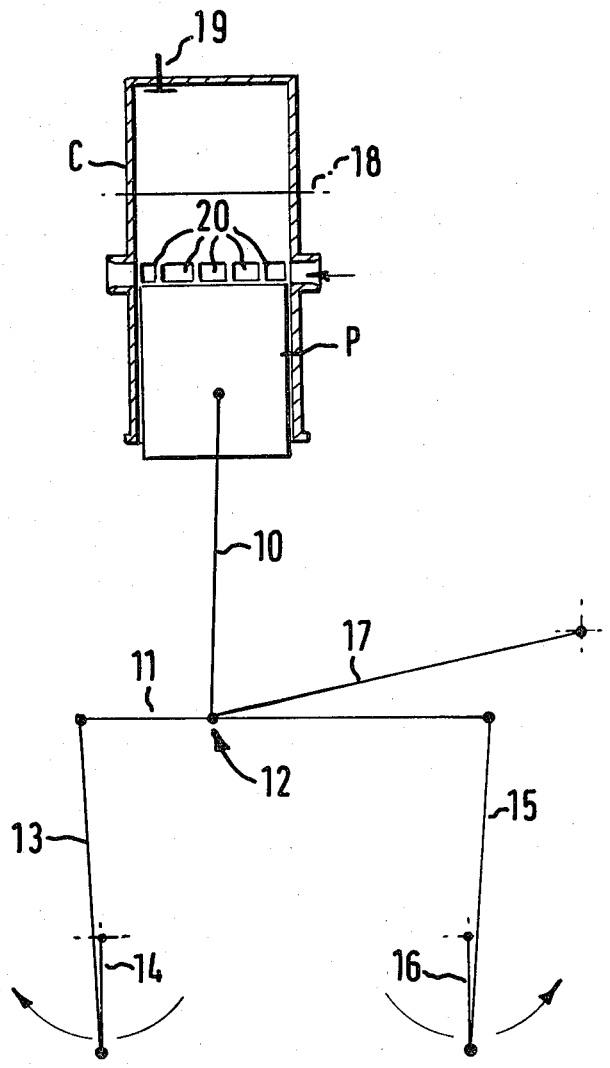
FIG. 10 illustrates an additional feature of advantage in reducing losses.

There will now be described an engine modification applicable to each of the foregoing engine arrangements. Referring to FIG. 10, this modification is shown as applied to a single cylinder four-stroke internal combustion engine as illustrated in FIGS. 1 to 4.

In the drawing, as before, the piston connection rod 10 is pivoted to a floating link 11 at point 12 which is nearer one end of the link than the other, the primary connection rod 13 joins the one end of the link 11 to the primary crank shaft 14 and the secondary connection rod 15 joins the other end of the link 11 to the secondary crank shaft 16. The shafts 14, 16 are coupled so that shaft 14 rotates at twice the speed of shaft 16 and the shafts rotate in opposite directions. A tracking arm 17 constrains point 12 to move substantially in a straight line.

The bottom dead centre position of the piston head on the induction stroke is indicated by dotted line 18, and according to the invention in addition to a conventional upper end exhaust valve 19 there are provided, spaced below the position 18, a ring of exhaust ports 20 in the cylinder C which ports are uncovered by the piston at the end of its power stroke as indicated by the full line position of the piston P Thus at the end of the power stroke the pressure within the cylinder C is rapidly reduced by the outflow of combustion gases through the ports 20 and the quantity of exhaust to be expelled through exhaust valve 19 is not only reduced but also its pressure is kept low so reducing the energy absorbed in the exhaust stroke.

I claim:

1. A four stroke internal combustion engine having at least one cylinder; a single reciprocating piston within the cylinder; valve controlled exhaust porting at the upper end of the cylinder; means for causing the piston to partake of a power stroke which is longer in length than the induction stroke of the piston, wherein the piston reaches essentially the same height within the cylinder at the end of the compression stroke as it does at the end of the exhaust stroke, said means comprising; a primary crank shaft and a secondary crank shaft, said crank shafts being drivingly coupled to rotate in opposite directions and said secondary crank shaft rotating at half the rotational speed of the primary crank shaft; a linkage connecting the piston to the said crank shafts; said linkage comprising a floating link, primary and secondary connecting rods pivoted to the ends of the floating link and to the primary and secondary crank shafts respectively, and a connecting rod connecting the piston to an intermediate point of the floating link nearer the end thereof to which the primary connecting rod is pivoted; and a tracking arm pivoted by one end and having its opposite end swinging in a shallow arc, said opposite end being pivoted on the floating link at said intermediate point; additional exhaust porting at the bottom of the cylinder and positioned to be uncovered by the piston at the end of the power stroke but remain covered at the end of the induction stroke, and wherein the opening and closing of said additional exhaust porting is controlled solely by the piston.

2. A four stroke internal combustion engine having a plurality of cylinders, a single piston in each said cylinder and valve controlled exhaust porting at the upper end of each said cylinder; means for causing the piston to partake of a power stroke which is longer in length than the induction stroke of the piston, wherein the piston reaches essentially the same height within the cylinder at the end of the compression stroke at it does at the end of the exhaust stroke, said means comprising; a primary crank shaft and a secondary crank shaft, said crank shafts being drivingly coupled to rotate in opposite directions and said secondary crank shaft rotating at half the rotational speed of the primary crank shaft; a linkage connecting each said piston to the said crank shafts, each said linkage comprising a floating link, primary and secondary connecting rods pivoted to the ends of the floating link and to the primary and secondary crank shafts respectively, and a connecting rod connecting each piston to an intermediate point of its respective floating link nearer the end thereof to which the primary connecting rod is pivoted and a tracking arm pivoted by one end and having its opposite end swinging in a shallow arc, said opposite end being pivoted on the floating link at said intermediate point; additional exhaust porting at the bottom of the cylinder and positioned to be uncovered by the piston at the end of the power stroke but remain covered at the end of the induction stroke, and wherein the opening and closing of said additional exhaust porting is controlled solely by the piston.

* * * * *